United States Patent [19]

Jones

[11] Patent Number: 4,718,137

[45] Date of Patent: Jan. 12, 1988

[54] AUTOMATED WASHER FOR CARGO CONTAINER

[76] Inventor: John L. Jones, P.O. Box 233, Pasadena, Calif. 91102

[21] Appl. No.: 929,324

[22] Filed: Nov. 10, 1986

Related U.S. Application Data

[60] Division of Ser. No. 882,160, Jul. 7, 1986, and a continuation of Ser. No. 649,522, Sep. 11, 1984, and a continuation of Ser. No. 732,303, May 9, 1985, and a continuation of Ser. No. 785,977, Oct. 10, 1985.

[51] Int. Cl.[4] ..... A46B 13/06

[52] U.S. Cl. ..... 15/56; 15/21 E

[58] Field of Search ..... 15/21 E, 56, 104.1 C, 15/93 A; 134/6

[56] References Cited

U.S. PATENT DOCUMENTS

| | | | |
|---|---|---|---|
| 4,279,052 | 7/1981 | Evrard et al. | 15/56 |
| 4,539,725 | 9/1985 | Smith | 15/56 |

FOREIGN PATENT DOCUMENTS

| | | | |
|---|---|---|---|
| 3311117 | 4/1984 | Fed. Rep. of Germany | 15/56 |
| 189892 | 11/1967 | U.S.S.R. | 15/21 E |
| 264440 | 6/1970 | U.S.S.R. | 15/56 |
| 401618 | 2/1974 | U.S.S.R. | 15/21 E |
| 567626 | 9/1977 | U.S.S.R. | 15/56 |

*Primary Examiner*—Edward L. Roberts

*Attorney, Agent, or Firm*—J. L. Jones, Sr.

[57] ABSTRACT

A cargo container wall and top lid washing machine has multiple rotating cylindrical sweeper brushes which are hydraulically rotated by detergent-water solution pumped throughout one or more water turbines, powered by electric motors, and water pumps. The multiple rotating sweeper brushes are planarly do-disposed and secured in a planar frame means, providing simultaneous scrubbing of the inside and outside walls of the multiple container lids and the inside and outside walls of the cargp container. The multiple rotating sweeper brushes can be simultaneously lowered around the set of open lids and into and outside of the cargo container walls. Multiple throttle valves control the flow rate of detergent cleaning solution to each cylindrical brush, the brushes being rotated by centrifugal rotating water turbine motors, whose hollow central shafts are extended to bearing journals disposed in paired, opposed, pivoted long, hollow tubular support mounts. The hollow control sweeper shafts are externally tufted with fiber tufts to provide a cylindrical brush, and are additionally provided with apertures along the shafts for flow of detergent solution. A rigid frame support means is permanently positioned and secured above on support columns. The rigid overhead frame means has sufficient free space below the frame means to freely contain the cargo container with cable supported upraised lids, and to contain the cable supported sweeper brushes and their cooperating operating brush structure.

3 Claims, 14 Drawing Figures

AUTOMATED WASHER FOR CARGO CONTAINER

CROSS REFERENCE TO RELATED APPLICATIONS

This is a division, of application Ser. No. 06/882,160 filed July 7, 1986.

This subject patent application is a continuation of a U.S. patent application by the same inventor filed Sept. 11, 1984 as Ser. No. 06/649,522 and titled MULTI-PURPOSE HEAVY DUTY CARGO CONTAINER, a second U.S. patent application filed May 9, 1985 as Ser. No. 06/732,303 and titled CARGO CONTAINER by the same inventor, a third U.S. patent application filed Oct. 10, 1985 as Ser. No. 06/785,977 and titled TOP COVER OF A CARGO CONTAINER by the same inventor, a fourth U.S. patent application filed July 7, 1986 as Ser. No. 06/882,160, and titled AUTOMATED WASHER FOR CARGO CONTAINER by the same inventor, said fourth patent application being pulled out as a fifth U.S. patent application division by the same inventor in U.S. Ser. No. 929,324, filed Nov. 10, 1986 for AUTOMATED WASHER FOR CARGO CONTAINER.

BACKGROUND OF THE INVENTION

The automated washer for cargo container of this invention is classified in Class 15, Subclasses 21E and 56.

A washing machine for waste containers is disclosed by Eskelmen in U.S. Pat. No. 4,485,513 issued Dec. 4, 1984. One or more large diameter brushes are driven at one brush end and have water nozzles spraying inside a dirty container. The one or more brushes have axis of brush rotation in close to the horizontal plane, driven by hydraulic or pneumatic motor means.

Wallasch and Grundler in U.S. Pat. No. 4,356,583, issued Nov. 2, 1982 disclose and teach a liquid operated reciprocating prime mover assembly and body washing apparatus incorporating the same. A body washing apparatus is carried on a rectilinear path, and has an operative rotatable brush traversing a straight line path for cleansing contact with a human user's body.

In U.S. Pat. No. 4,279,052, issued July 21, 1981 to Evnard and Kamalich, a flue wall coke build-up removal device is taught for cleaning opposed walls of a furnace pit. A plurality of rotating screw type cutters remove build-up deposits on opposed walls of a furnace pit. A piston-cylinder arrangement moves a plurality of rotating screw type cutters in and out of engagement with the built-up deposits upon the opposed walls of the furnace pit.

Rogers in U.S. Pat. No. 4,240,175 issued Dec. 23, 1980, discloses an apparatus for washing the interior of an elongated rectangular freight container. A wash dolly on a transfer carriage is positioned adjacent an open end of a freight container. The wash dolly is propelled into alignment with the open end of the freight car by a mobile platform.

Dietrich in U.S. Pat. No. 4,149,292 issued Apr. 17, 1979, discloses a machine for washing containers of all open types. A single rotary brush is driven by a hydraulic or electric motor. A cleaning fluid injection tube supplies cleaning fluid under pressure.

Jeffreys in U.S. Pat. No. 3,479,678 issued Nov. 25, 1969 discloses a mold cleaner device. A rotary brush device provides scrubbing of a casting cavity of a graphite mold. Rotary brushes are attached to an overhead trolley which guides the brushes through the open mold.

SUMMARY

FIG. 1 discloses a cargo container wall and lid washing machine whose multiple rotating cylindrical sweeper brushes are hydraulically driven by detergent-water solution pumped by one or more water turbines powered by a separate water pump. The multiple rotating sweeper brushes are planarly co-disposed and secured in a frame means, providing simultaneous scrubbing of the inside and outside cargo container walls. The multiple rotating sweeper brushes are all disposed in a single geometrical plane and can be simultaneously lowered into and outside of the cargo container through an open set of hinged lids which completely cover the cargo container top. The multiple open set of hinged cargo container multiple lids are lifted to vertical positions by the cables attached to the multiple lids, which are operated by one or more winches disposed above on a rigid frame means. The opened empty cargo container is positioned and indexed below the rigid frame means. The washing machine with the sweeper brushes is lowered around the vertical lids and the inside and outside of the cargo container. The rigid frame means is permanently positioned and secured above the cargo container on structured support columns. The rigid frame means has sufficient free space below the frame means to freely contain below the multiple sweeper brushes and their cooperating operating brush structures, together with the cargo container with its vertically open multiple lids disposed below the sweeper brushes and their cooperating brush structures.

The flow rate of the pumped detergent-water solution is adjusted by throttle valves controlling each rotating sweeper brush to provide the needed cleaning solution inside and outside the cargo container components. The rotating cylindrical sweeper brushes are mounted in paired, opposed, pivoted long tubular mounts, the paired mounts being operatively disposed and rotatively secured to the frame member at opposed termini of the cylindrical brushes. The brushes have tubular shafts secured in bearing journals disposed in the long tubular mounts. The long tubular mounts are adaptively sized in length to pivotally move from the top of the vertically open lid to the base of the cargo container. The cylindrical tufted brushes are centrally secured in the tubular shafts. The hollow tubular brush shafts are each centrally disposed and secured to the eye of a water turbine rotor and hydraulically connected as the water output of the turbine. The hollow tubular brush shaft has multiple radial apertures disposed therein, adjacent multiple radial brush tufts. The water inlet case of the water driven turbine is mechanically positioned and permanently non-rotatively secured between the paired mounts for the cylindrical brush, the adjacent brush tufts being disposed to flexibly cover the turbine case and brush the cargo container wall. Each rotating cylindrical brush is supplied a constant flow stream of detergent-water solution throughout the brush length to flood and wipe clean the multiple lids and inner and outer wall of the cargo container.

The inlet detergent-water solution is also piped through the pivoted vertical long tubular mounts, and the solution can be sprayed on the scrubbed inner and outer cargo container walls. The multiple turbine cases are adaptively positioned in the cylindrical brush array to provide apertues in the brush array, whereby the set of brushes scrubbing the complete four walls of the cargo container can be lowered around the roof trusses which support and rigidify the free upper edges of the cargo container walls.

As the sweeper machine is constructed, the multiple container lids, and then the four walls of the container, inside and outside, are scrubbed as the pivoting scrubber brushes are slowly lowered into the interior and around the cargo container exterior, the array of turbine driven brushes having gaps in the brush array for the roof trusses. The pivoted, vertical long tubular mounts have adaptively sized dead weights secured on each vertical tube adjacent the flattened mount for the scrubber brush journals, providing the necessary pressure on the container walls for proper scrubbing.

Winch driven cables can lower the rigid frame means supporting the paired, pivoted, opposed long tubular mounts at a selected slow linear rate down the side of the container wall. The container lids are maintained in a vertical position during the scrubbing process. The scrubbing process can be automatically computer programmed. The rinsing of the scrubbed wall can be done during the machine withdrawal from the cargo container, using another water source.

The empty cargo container can be indexed to a specific position on an open mesh reinforced metal flooring, above a shallow catch basin lined with concrete or plastic sheeting. A dip pipe is positioned in the catch basin and filtered detergent-water solution pumped from the catch basin, pumped through the sweeper machine pipe inlet, to all rotating sweeper brushes, and finally drained into the catch basin again, carrying the debris of the granular cargo of the cargo container. The debris can be settled in the catch basin, and the detergent-water solution used again, with make-up detergent solution. A filter for the detergent solution can be useful. By indexing the cargo container basin on the open mesh metal flooring, the sweeper machine is properly indexed and positioned to accommodate the roof trusses and the indexed gaps between the rotating scrubber brushes.

A single cylindrical sweeper brush, also rotatively driven by a water turbine detergent solution, and mounted between a pair of opposed tubular mounts and secured in bearing journals, can be utilized to manually scrub the floor of the cargo container, removing debris washed to the floor.

Included in the objects of this invention are:

To provide a cargo container wall and top lid washing machine having multiple rotating cylindrical sweeper brushes.

To provide multiple rotating cylindrical brushes which are powered by detergent-water solution, pumped in rotation by one or more water turbines.

To provide multiple rotating cylindrical sweeper brushes in a cargo container washing machine, all of the brushes being coplanarly disposed in a single geometrical plane.

To provide a cargo container with a full top lid opening and a rear door, with a wall washing machine which can wash the inside and outside walls of the cargo container simultaneously.

To provide a cargo container wall and top lid washing machine which can be operatively lowered around the upraised top lid and cargo walls of the container.

To provide a cargo container floor washing device which utilizes one or more cylindrical sweeper brushes with a water driven turbine sweeper drive.

To provide a cargo container with at least four rigid open lid top covers which fully cover the container top area.

Other objects and advantages of this invention are taught in the following description and claims.

BRIEF DESCRIPTION OF THE DRAWINGS

The description of this invention is to be read in conjunction with the following drawings:

FIGS. 9-9A-A-1 to 9A-A-2 to 9B-B-1 illustrate in several plan views of the typical bonding by welding of the truss means shown in FIG. 8.

DESCRIPTION OF THE PREFERRED EMBODIMENT OF THE INVENTION

Figure 1:
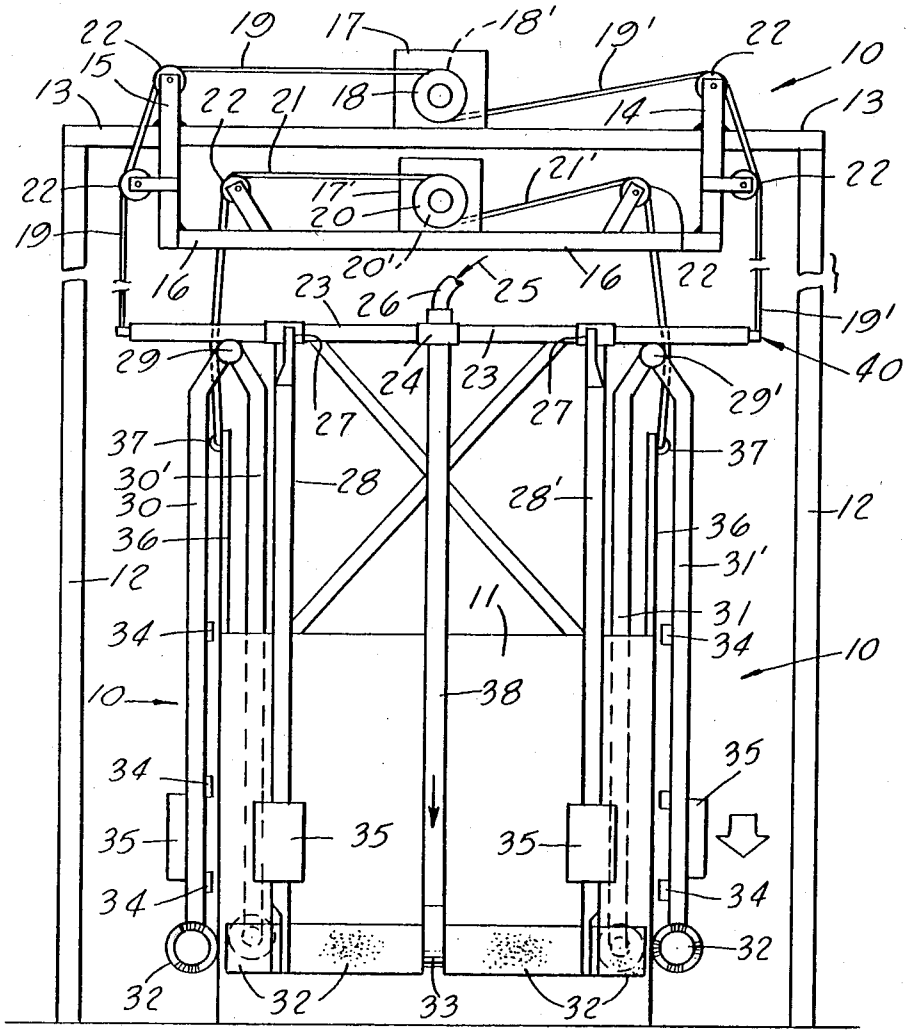
FIG. 1 is an elevational exterior end view of the automated washer for a cargo container, said washer positioned to provide the simultaneous washing of the exterior and interior walls of the cargo container.

FIG. 1 discloses in end elevational view a projection of an automated washing machine 10 with a cargo container 11 disposed in said washing machine 10. The machine 10 has multiple load supporting columns 12 and multiple fixed stress frame members 13, 14, 15, 16. The columns 12 and frame members 13–16 are adaptively sized, shaped and fixedly secured to provide exterior load and stress platform members for the cylindrical brush elements of the washing machine 10 disposed and positioned in an indexed position. The two electric motor driven, double ended, speed reducing cable drives 17, 17′ are adaptively fixedly secured to the respective frame members 13 and 16. Dual pulleys with cable reservoir volumes 18 and 18′ (not shown) are affixed to the dual opposed shaft ends of cable drive 17 and are secured to load cables 19 and 19′. A second set of dual pulleys with cable reservoir volumes 20 and 20′ (not shown) are affixed to the dual opposed shaft ends of cable drive 17′, and are secured to a second set of load cables 21 and 21′. Multiple positioning and guidance grooved pulleys 22 are disposed and secured to provide guidance for the set of load cables 19, 19′ and 21, 21′.

The detergent-water solution for washing the cargo container 11 is carried into the mobile washing unit 40 by the load carrying hollow pipe 23 which is typically supported by the pair of cables 19 and 19′. The first hollow tee coupling 24 introduces the detergent-water solution 25 through the flexible hose 26, into the pipe 23.

A second dual set of hollow tee couplings 27 are rotatable 90° through the plane of the paper and carry the detergent-water solution 25 down into the first and second pipe support members 28 and 28′. The dual pipe support members 28 and 28′ are flattened at both pipe termini, to provide almost water-tight journaled fittings and lubricated by the solution 25. A third and fourth dual set of hollow tee couplings 29 and 29′ are adaptively conductively secured to 23, at both termini of 23, the couplings 29 and 29′ being rotatively adapted to rotate in the plane of the paper, each leg for an angle of 90° from perpendicular. The third and fourth set of couplings 29 and 29′ each have dual pipe support members 30, 30′ and 31, 31′ conductively and rotatively supported thereto. The pipe members 30, 30′, 31, 31′ are adaptively adjusted in length to provide individual journaled apertures in a single plane which can support in pipe member pairs, the tubular perforated shafts of multiple cylindrical tufted brushes 32. Brushes 32 rotate under the pressure of detergent-water solution 25 as it is forced through a water turbine 33, typically. The eye of the water turbine 33 supports the tubular shaft of the brushes 32, causing the brush 32 to rotate as solution 25 exits through multiple apertures in the brushes 32, 32′, washing the cargo container 11 inside and outside. The multiple sprinkler heads 34 are disposed and secured on the pipe support members 30, 30′ and 31, 31′ disposed and regulated in flow to face the walls of container 11 and conductively connected to the detergent-water solution 25 flowing inside of members 30, 30′ and 31, 31′, spraying solution 25 on the container 11.

The multiple weights 35 are adaptively sized and secured on the exterior faces of pipe support members 30, 30′, 31, 31′ and 28, 28′ and the like, providing gravity actuating forces which tend to keep the rotary sweeper brushes pressed against the interior and exterior walls of container 11 and ensuring a washing and brushing action on the walls, exterior and interior walls of container 11.

Figure 10:
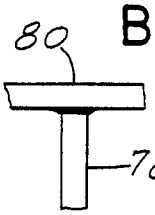
FIG. 10 is an elevational projective view of a partial section of an automated washer for a cargo container disposed permanently on support column means, first cable means supporting the cargo container lids, and second cable means supporting the lowered rotary scrubbing brushes inside and outside the cargo container.
Figure 10:
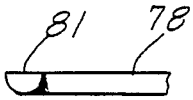
Figure 10:
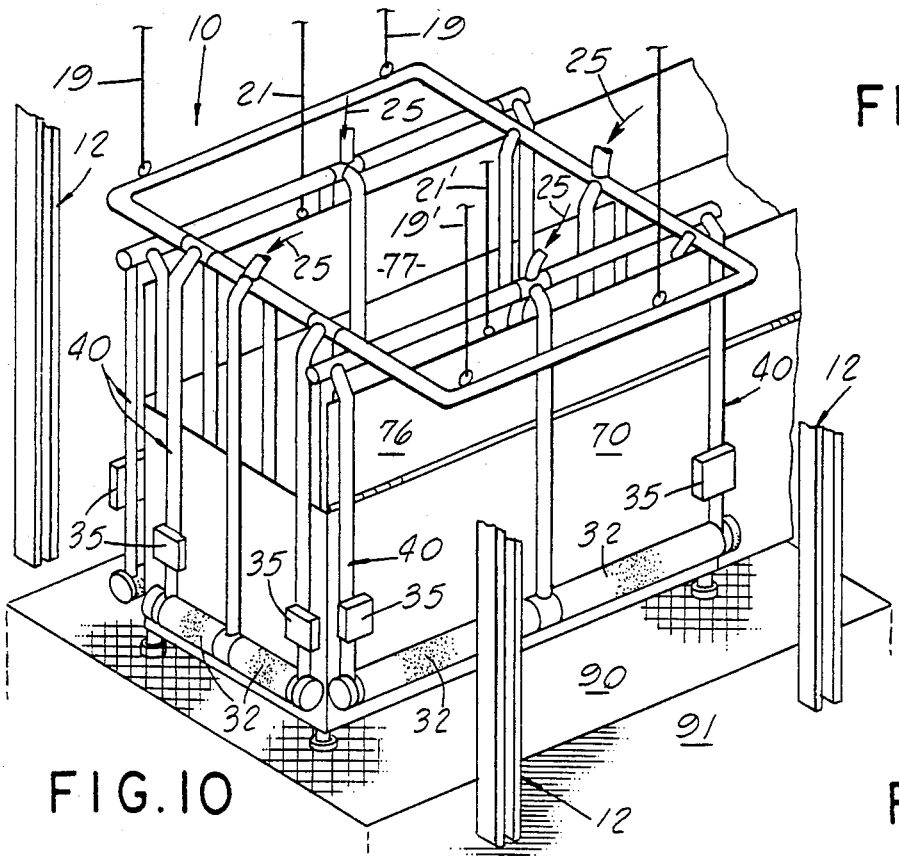

Operationally, the washing machine 10 is disposed in position and supported with the multiple fixed stress frame members 13–16, all fixed in position over a detergent solution pond 91, as in FIG. 10 (partially shown). The mobile washing unit 40 of machine 10 normally is hoised in the air by first load cables 19,19′ well above the dirty cargo container 70, the sweeper brushes 32 being approximately 15 feet above the bottom rigid wall of container 70. The container 70 has the quarter lids 36,36′ raised vertically in the air, supporting the rings 37,37′ of lids 36,36′ by the second load cables 21,21′ wound on the positioning and guidance pulleys 20,20′ driven by the cable drive 17′. By lifting and positioning container 70 by cables 21,21′, it is possible to index and register the container 70 into the exact required position under the rotary sweeper brushes 32.

The rotary sweeper brushes 32 pivoting on their pipe support members, 28,28′,30,30′,31,31′ at the pivot couplings 27,27′,29,29′ supply detergent-water solution 25 to the rotary sweeper brushes 32 and to sprinklers 34. The brushes 32 are kept rotating by the pressurized water 25 supplied to the water turbine 33 through pipe 38 which supports the tufted brushes 32 and water turbine 33.

After positioning container 70 under the mobile washing components 40 of machine 10, the rotary sweeper brushes 32 are slowly lowered around the container lids 76 and the detergent solution 25 is supplied by an unshown computer programmer to the brushes 32. The lids 76,77 are washed on both faces as the load cables 21 and 21′ are unwound at a controlled speed. The inside and outside walls of container 70 are also washed and rinsed in a like manner.

Figure 2:
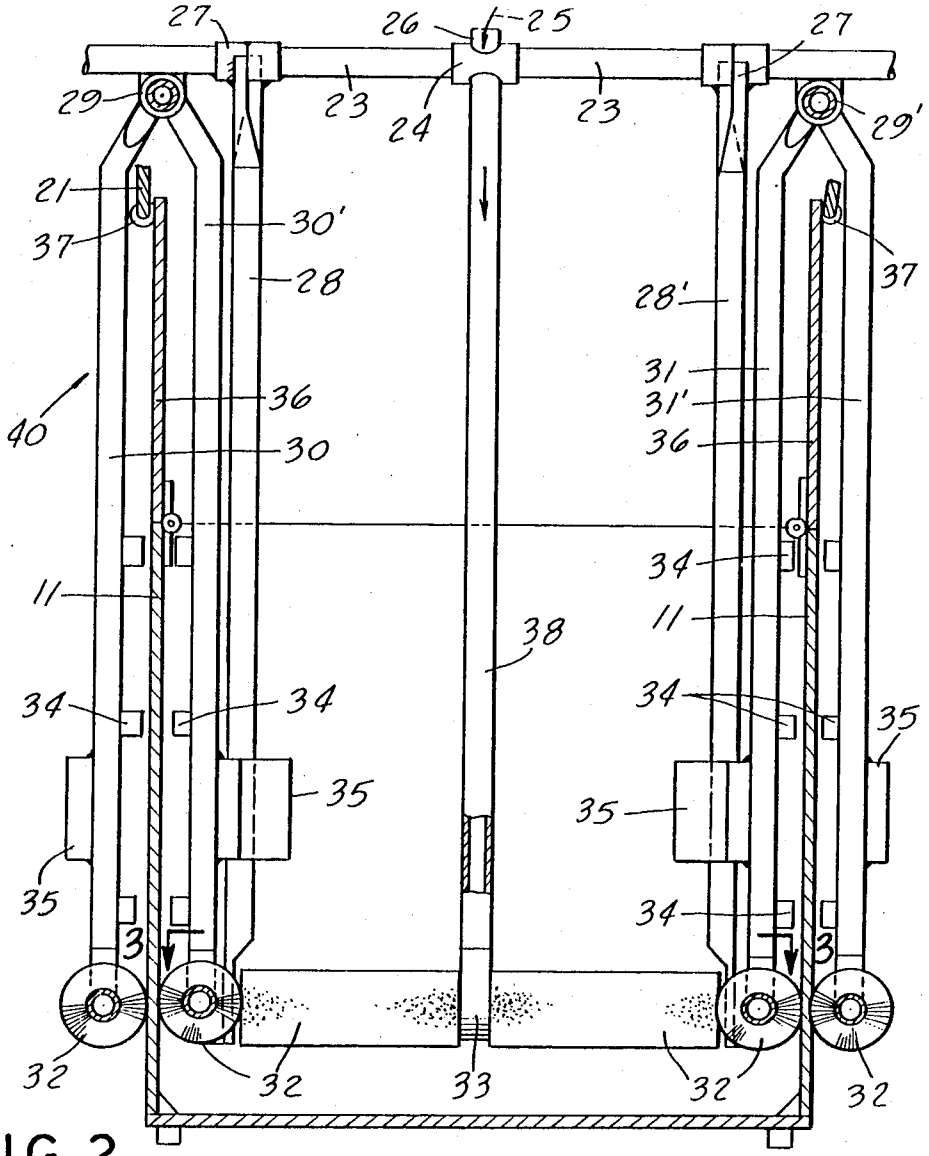
FIG. 2 is a partial cross sectional enlarged view through the rotary scrubbing brush operation of FIG. 1 omitting the cable lifting and lowering details of FIG. 1.
Figure 5:
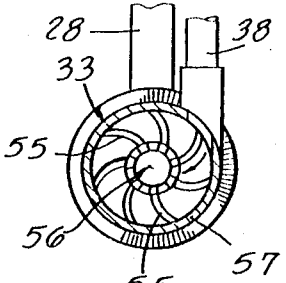
FIG. 5 is an elevational sectional view of a water turbine impeller and fixed position turbine case.

FIG. 2 illustrates in greater detail the mobile washing unit 40 in principle. The load carrying hollow pipe 23 also carries detergent-water solution 25, introduced through the flexible hose 26, which is conductively secured to the first hollow tee 24. The second dual set of hollow tee couplings 27,27′ are rotatable 90° through the plane of the drawing paper, carrying solution 25 down into the first and second pipe support members 28 and 28′. A third and fourth dual set of hollow tee couplings 29 and 29′ are adaptively conductively secured to 23, rotatively at a 90° angle in the plane of the paper drawing from the perpendicular. The dual pipe support members 30,30′ and dual pipe support members 31 and 31′ are rigidly conductively connected to tee couplings 29 and 29′. The lower flattened ends of pipe support members 28,28′, 30,30′ and 31,31′ have journaled support bearings for the multiple cylindrical sweeper brushes 32. The pipe 38 feeds detergent-water solution 25 to the water turbine 33 which in turn supports the sweeper brushes 32. The sweeper brushes 32 are equal in lengths and have tubular shafts tufted with multiple fiber tufts and have multiple solution aperture disposed therein (not shown). The tubular shafts of paired brushes 32 are supported in the eye 56 of the water turbine 33 of FIG. 5. The turbine case 55 is fixed in position by the rigid pipe 38, providing reaction to the turbine wheel 55, which is rotated by the impinging solution 25 through pipe 38.

Figure 3:
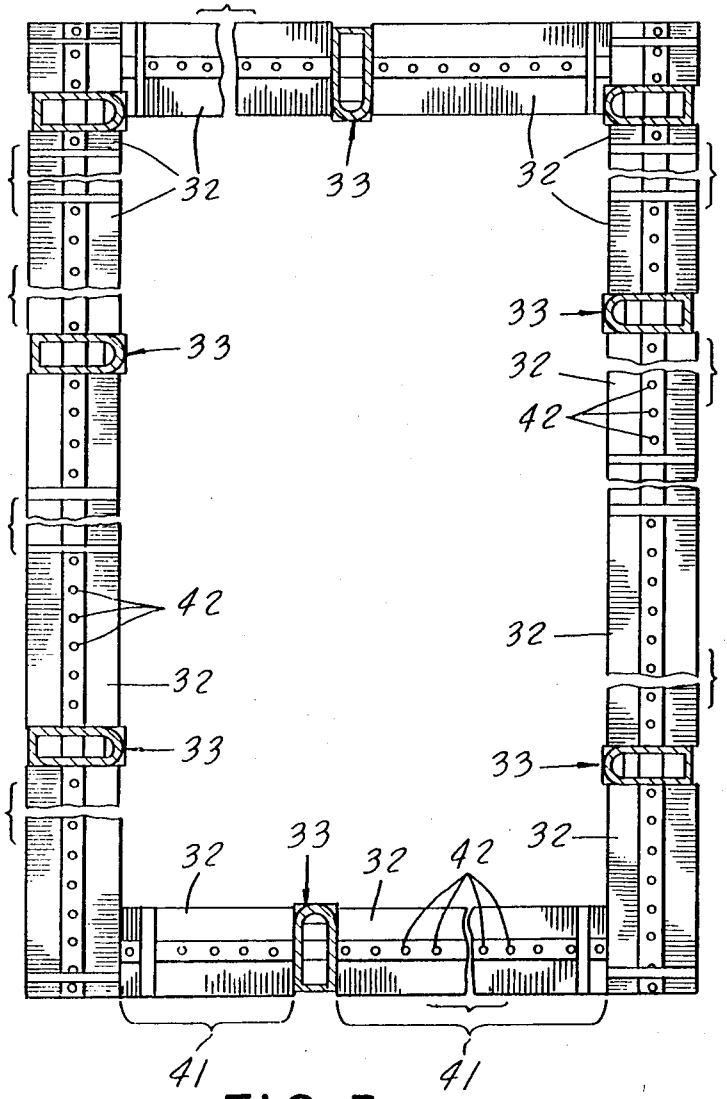
FIG. 3 is a plan sectional view through 3—3 of FIG. 2 illustrating the instantaneous positioning of the rotary scrubbing brushes which can be coplanarly disposed inside and outside of the cargo container walls, for concurrently scrubbing of the cargo container walls.

The mobile washing unit 40 can be replicated in coordinates by multiples to provide scrubbing brushes in the quantity for scrubbing the inside and outside of the complete perimeter of surface wall area of the cargo container in continuum, as is typically illustrated in FIG. 3. The rectangular pattern of scrubber brushes 32 of FIG. 3 can be adaptively sized to concurrently fit outside and inside of a cargo container 11, providing concurrent scrubbing continuously of the inner and outside perimeter of the container 11 in a single geometrical plane, as the mobile wahsing units 40 are lowered inside and outside of the container 11. The mobile balanced scrubbing brushes 32 are typically of equal lengths 41 on either side of the water turbine 33, being secured to the water turbine wheel eye 56 (FIG. 5) of turbine wheel 55.

By reason of apertures in the tubular brush lengths 41, at the wheel 55, water-detergent solution 25 exits the brushes 32 at apertures 42, providing cleaning and scrubbing solution for clinging debris on the walls of container 11. The equal lengths 41 of brushes can be typically 2, 3 or 4 feet long or the like. Tufts of brushes are disposed at the brush ends to provide brush scrubbing capability at brush ends to cover scrubbing of all the container 11 walls.

Figure 4:
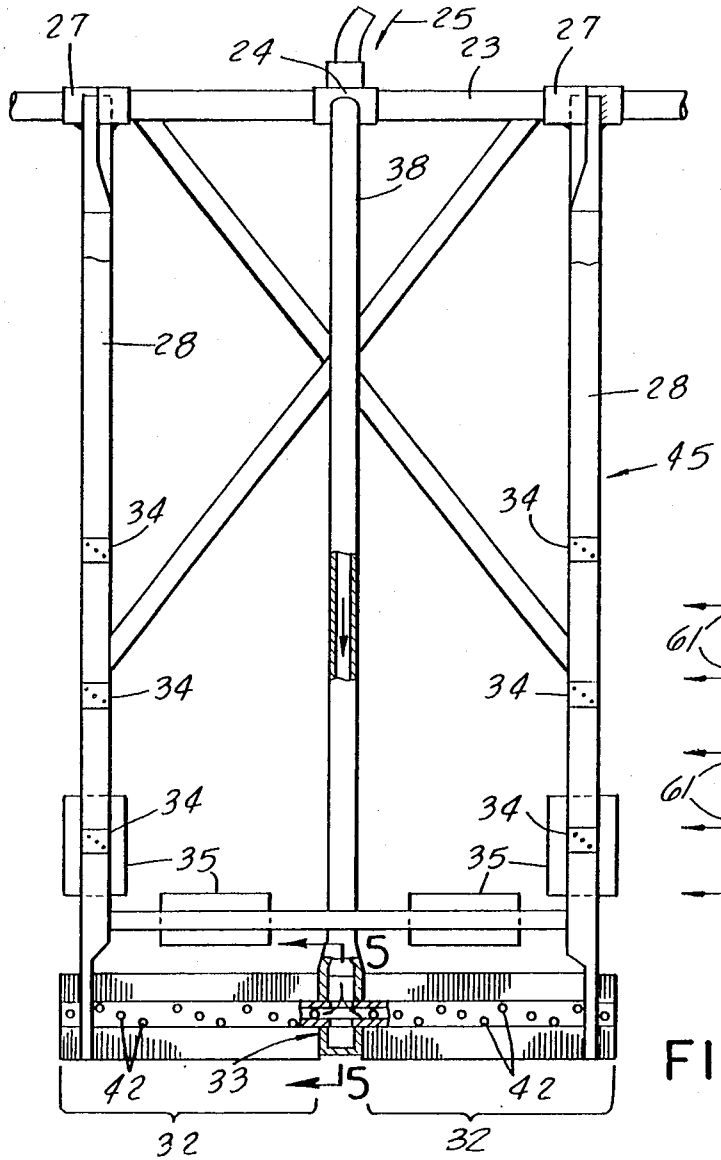
FIG. 4 is a single pivoted scrubbing brush unit which can be positioned inside or outside the cargo container wall, as in FIG. 1, and the brush unit being rotatively driven for scrubbing debris off the container wall by detergent-water solution pumped through a water turbine and brush apertures.

FIG. 4 is a more detailed view of a sub-unit of mobile washing unit 40 of FIG. 2 in which a typical rotary scrubbing brush unit 45 is shown in elevational view, the detergent-water solution 25 entering 45 at the tee 24, 25 travels through pipe 38 and pipe support members 28 and 28' to journaled bearings at the flattened tube ends supporting scrubber brushes on the brush lengths of tubing 41. The perforated apertures 42 are disposed in adaptively selected, positioned and sizes on 41. The exterior turbine case 57 is fixed in position by rigid pipe 38. The turbine case 57 also supports the tubing lengths 41.

Figure 6:
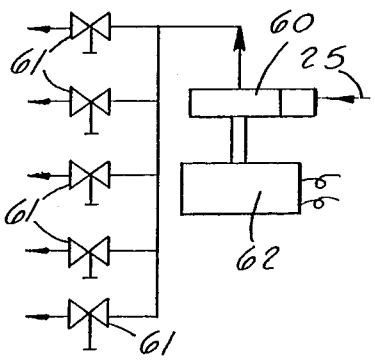
FIG. 6 is a schematic outline of an electric motor driving a detergent-water solution pump whose pump capacity is equivalent to the total capacities of all the water turbines which rotate the rotary sweeper brushes concurrently. The valves are schematic valve connections which throttle flow rates of the detergent-water solutions delivered to the scrubber brushes.

The multiple throttle valves 61 are schematically shown in FIG. 6, regulating the flow of detergent-water solution 25 picked up by pump 60, as driven by electric motor 62. The valves 61 can regulate the flow of 25 to the multiple mobile washing units 40. The pump 60 has the solution capacity to supply all of the multiple units 40 at one time.

Figure 7:
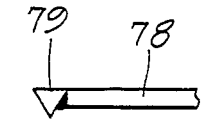
FIG. 7 is a schematic elevation and projective view of a cargo container having four intersecting flat rigid hinged quarter top lids extending the length of the two rigid panel sides, and covering the full width of the cargo container.
Figure 7:
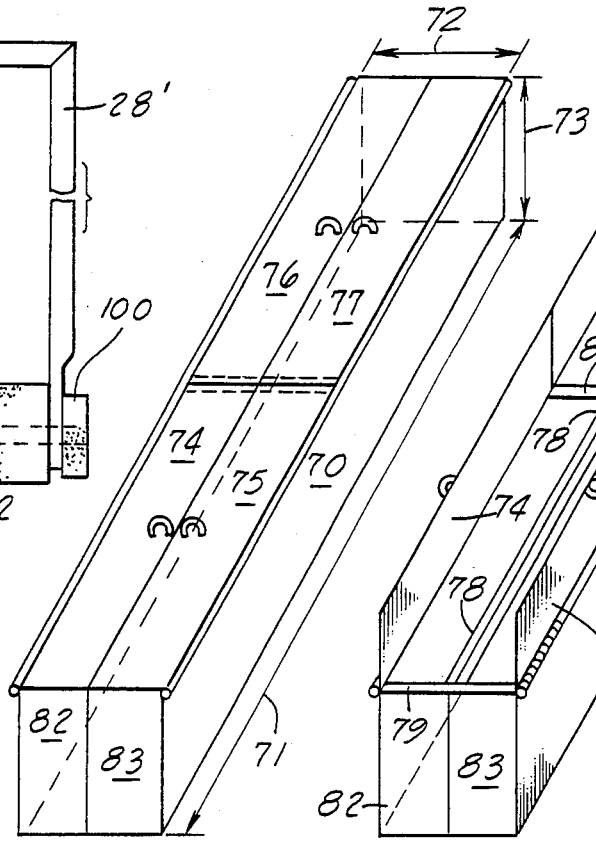
Figure 8:
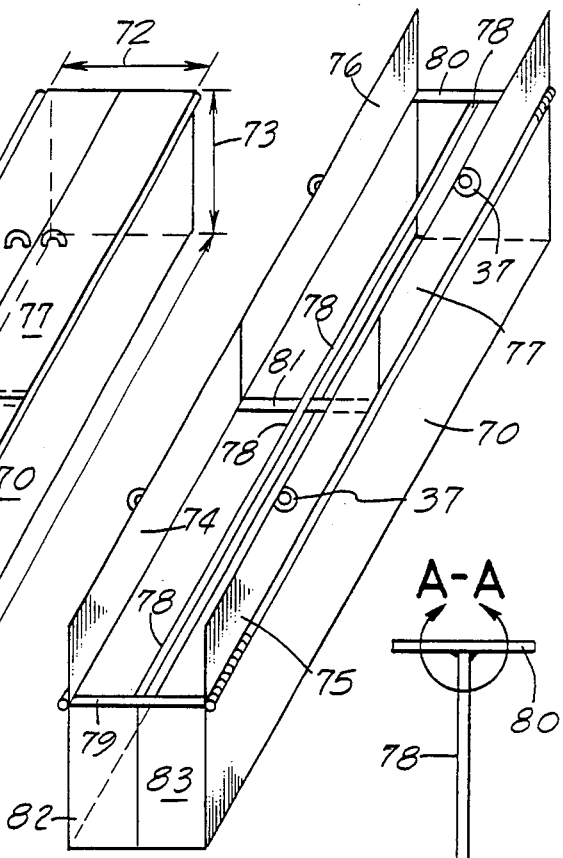
FIG. 8 is another schematic elevational projective view of the cargo container of FIG. 7 with the quarter top lids opened and extending upright in the air, and showing the truss means which extend across and lengthwise of the container, supporting the four lids.
Figure 9:
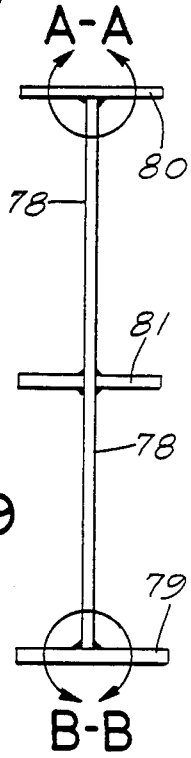

FIG. 7 illustrates a multiple four lidded cargo container 70 in perspective projective schematic view, having a length 71, a width 72, and a depth 73. In operation the container length can typically be 10, 20, 30, 40 feet. The width 72 can be 7, 8, 9, 10, 11, 12 feet, typically and the depth 73 can be typically 7, 8, 9, 10, 11, 12 feet. The four top rigid lids 74, 75, 76 and 77 can be equal in area, or can be unequal in area, as required by loading or load equalization requirements. The top rigid lids 74–77 are required to cover the top of container 70 in toto. All of top lids 74–77 can be opened on hinges, as shown in FIG. 8. The top lids 74–77 rest on the truss members 78, 79, 80 and 81 as shown in FIG. 9. The truss members are joined together as illustrated by the flat welding cross sections of FIGS. 9A-A-1, 9 A-A-2, and 9 B-B-1. The truss members are also welded to the side walls of container 70, as in joints 9 A-A-1 to 9 B-B-1 to provide container 70 rigidity.

Referring to FIG. 10 in detail, an end projective partial view of a cargo container such as 70 is shown disposed and indexed in position on a partial section of an expanded floor grid 90 which can allow detergent-water solution 25 to flow down the interior and exterior of container 70. The automated washing machine 10 has multiple load supporting columns 12 partially shown, supported on the ground, the grid 90 being disposed and secured on posts over a waterproof lined ground pond 91. A multiplicity of mobile washing units 40 are shown disposed over the container 70, supported in the fully washed position of container 70, by the load cables 19,19'. The partial top rigid lids 76 and 77 are upraised for washing, by cables 21,21'. The cable sets 19,19' and 21,21' are unwound off grooved pulleys 18,18' and 20,20' at a controlled rate by a computer drive (not shown) which allows the brushes 32 to wash debris off the walls of 70, as well as the lids of 76 and 77 and the like. The dirty detergent-water solution 25' falls into the pond 91 below the grid floor 90, where the debris settles and the filtered detergent-water solution is pumped out of pond 91 and recirculated for cleaning more containers 70.

Figure 11:
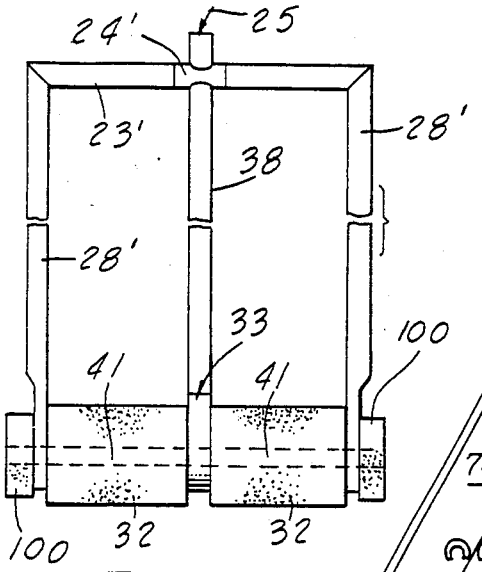
FIG. 11 is a plan view of a rotary scrubbing brush component useful for scrubbing the interior of the cargo container flat rigid box bottom manually by a single worker.

FIG. 11 illustrates a pair of cylindrical sweeper brushes 32 having a pair of support wheels 100 slightly smaller in diameter than 32. The brushes 32 are formed on hollow brush tubular lengths 41, having solution apertures 42. The pipe support members 28,28' and the pipe support member 23', all carry detergent-water solution 25 through coupling 24' to rigid pipe 38 and water turbine 33. The brushes 32 are rotated by water pressure of turbine 33 to rotate 32, manually sweeping dirt off cargo container bottom wall. The walls of cargo container 11 can be swept by an automatically programmed sweeper machine 10, while a single manual operator is inside the container 11, also sweeping the bottom wall of container 11.

The inventor of this application specifically applies by reference all of the previous pending patent applications by this same inventor to this present application, namely U.S. Ser. Nos. 06/649,522 of Sept. 11, 1984; 06/732,303 of May 9, 1985; and 06/785,977 of Oct. 10, 1985, for the inventive advances taught therein.

Many modifications in the automated washer for cargo containers can be made in the light of my teachings. It is understood that within the scope of the claims, the invention can be practiced otherwise than as described.

I claim:

1. An automatic washer for a cargo container having a completely open top rigid lid, comprising in combination:

multiple adaptively spaced, sized and fixed ground position, load support columns, multiple fixed stress frame horizontal and vertical members, affixed to the upper level of said load support columns, at least two separate electric motor powered cable hoists, each one of said cable hoists having double ended rotating power shafts, each shaft having a cable hoist pulley disposed and secured thereon, said cable hoists disposed and secured on said horizontal stress frame members, said pulley power shafts disposed parallel to said ground position, at least two separate dual opposed sets of load cables, each cable adaptively secured at one cable termini to each one of said cable hoist pulleys, said load cables having lengths at least reaching said ground, multiple sets of grooved guidance pulleys, positioned and adaptively permanently placed to guide each one of said at least separate dual opposed set of load cables, providing direct vertical load lifting, multiple horizontal load carrying first hollow pipe length for detergent-water solution flow, each said first hollow pipe length having a first hollow tee coupling conductively disposed midway in the hollow pipe length, each said pipe length supported on the two termini of said first hollow pipe length by two opposed dual cable termini, multiple second hollow rigid pipe length conductively connected at a second rigid pipe first terminus, carrying detergent-water solution from said first hollow tee coupling to a selectively distantly spaced below water turbine adaptively sized, and having an input securely connected to said second hollow rigid pipe length second terminus, said turbine having a turbine rotor and a turbine rotor eye, said rigid second pipe length longer than the height of said cargo container plus the vertical height of the upraised hinged lids of said container, multiple third hollow brush length pipes disposed and permanently conductively secured in the eye of the water turbine rotor, one-half length of said third brush pipe being disposed on one side of said turbine rotor and one-half of said length of third pipe being disposed on a second side of said turbine rotor, random apertures being disposed through said third brush length pipe, multiple equal length brush fiber tufts being radially disposed and secured in said brush pipe, providing cylindrical balanced sweeper brush pairs, said turbine rotor providing rotative power to the sweeper brush pairs, multiple pairs of hollow fourth opposed conductive pipe support members having pipe first termini journaled to rotatively support said sweeper brush pairs, said fourth pipe pair support members second termini conductively connected to a pair of rotatable couplings disposed in said first horizontal load carrying hollow pipes, a multiple mobile washing unit having cooperatively one of aforesaid multiple horizontal load carrying first hollow pipes for detergent-water solution, one of aforesaid multiple second hollow rigid pipes, one of aforesaid third brush length pipes and water turbine providing one of aforesaid sweeper brushes pairs, and one of aforesaid multiple pairs of opposed fourth conductive pipe support members, said multiple mobile washing units being closely adjacently coplanarly aligned at their respective sweeper brushes around the interior perimeter and separately around the exterior perimeter of aforesaid cargo container and the container vertically raised lids, providing a concurrent washing of the debris from the interior and exterior side walls of the cargo container as the detergent-water solution is programmed over the side walls and the top lids, and washed by lowering aforesaid load carrying cables supporting aforesaid rotating sweeper brushes.

2. In the combination set forth in claim 1, the further modification comprising in combination:

an expanded grid floor, horizontally disposed and secured inside the perimeter of said load supporting columns, disposed on load supporting piers, and providing a supporting means for said cargo container, positioning means for said container, disposed and secured to position said container on said expanded grid floor, providing direct load carrying attachment to aforesaid load cables for said top container lids, a waste detergent-water solution collection pond disposed beneath said expanded grid floor, said pond having a water-proof liner for said solution, a water pump and detergent-water solution filter disposed and secured for collecting and recycling said solution flow through said multiple horizontal load carrying first hollow pipes, entering aforesaid pipes through said first hollow tee couplings.

3. An automatic washer for a cargo container having a completely open top rigid lid, and also having a multiple adaptively spaced, sized and fixed ground position, load support columns, and also having a multiple fixed stress frame horizontal and vertical members affixed to the upper level of said load support columns, and also having at least two separate electric motor powered cable hoists, each one of said cable hoists having double ended rotating power shafts, each shaft having a cable hoist pulley disposed and secured thereon, comprising in combination:

at least two separate dual opposed sets of load cables, each cable adaptively secured at one cable termini to each one of said cable hoist pulleys, said load cables having lengths at least reaching said ground, multiple sets of grooved guidance pulleys, positioned and adaptively permanently placed to guide each one of said at least separate dual opposed set of load cables, providing direct vertical load lifting, multiple horizontal load carrying first hollow pipe length for detergent-water solution flow, each said first hollow pipe length having a first hollow tee coupling conductively disposed midway in the hollow pipe length, each said pipe length the two termini of said first hollow pipe length by two opposed dual cable termini, multiple second hollow rigid pipe length conductively connected at a second rigid pipe first terminus, to carry carrying detergent-water solution from said first hollow two coupling to a selectively distantly spaced below water turbine adaptively sized, and having an input securely connected to the said second hollow rigid pipe length second terminus, said turbine having a turbine rotor and a turbine rotor eye, said rigid second pipe length longer than the height of said cargo container plus the vertical height of the upraised hinged lids of said container.

multiple third hollow brush length pipes disposed and permanently conductively secured in the eye of the water turbine rotor, one-half length of said third brush pipe being disposed on one side of said turbine rotor and one-half of said length of third pipe being disposed on a second side of said turbine rotor, random apertures being disposed through said third brush length pipe, multiple equal length brush fiber tufts being radially disposed and secured in said brush pipe, providing cylindrical balanced sweeper brush pairs, said turbine rotor providing rotative power to the sweeper brush pairs, multiple pairs of hollow fourth opposed conductive pipe support members having flat pipe first termini journaled to rotatively support said sweeper brush pairs, said fourth pipe extending from said first hollow tee coupling to a selectivley distantly spaced below water turbine adaptively sized and turbine input securely connected to the hollow rigid pipe second terminus, said rigid pipe length longer than the height of said cargo container plus the vertical height of the upraised hinged lids of said container, a multiple mobile washing unit having cooperatively one of aforesaid multiple horizontal load carrying first hollow pipes for detergent-water solution, one of aforesaid multiple second hollow rigid pipes, one of aforesaid third brush length pipes and water turbine providing one of aforesaid sweeper brushes pairs, and one of aforesaid multiple pairs of opposed fourth conductive pipe support members cooperatively providing one of multiple mobile washing units , said multiple mobile washing units being closely adjacently coplanarly aligned at their respective sweeper brushes around the interior perimeter and separately around the exterior perimeter of aforesaid cargo container and the container vertically raised lids, providing a concurrent washing of the debris from the interior and exterior side walls of the cargo container as the detergent-water solution is programmed over the side walls and the top lids, and washed by lowering aforesaid load carrying cables supporting aforesaid rotating sweeper brushes.

* * * * *